US006186480B1

(12) United States Patent
Leteurtre

(10) Patent No.: US 6,186,480 B1
(45) Date of Patent: Feb. 13, 2001

(54) TRIAXIAL POSITIONING ACTUATOR AND CONTROL METHODS USING SAME

(75) Inventor: Patrick Leteurtre, Montpellier (FR)

(73) Assignee: Nanotec Solution, Nimes (FR)

( * ) Notice: Under 35 U.S.C. 154(b), the term of this patent shall be extended for 0 days.

(21) Appl. No.: 09/077,788

(22) PCT Filed: Dec. 6, 1996

(86) PCT No.: PCT/FR96/01955

§ 371 Date: Jun. 8, 1998

§ 102(e) Date: Jun. 8, 1998

(87) PCT Pub. No.: WO97/21929

PCT Pub. Date: Jun. 19, 1997

(30) Foreign Application Priority Data

Dec. 8, 1995 (FR) ..... 95 14529

(51) Int. Cl.[7] ..... B66F 5/00
(52) U.S. Cl. ..... 254/84; 254/2 R
(58) Field of Search ..... 180/8.1, 8.5; 254/84, 254/85

(56) References Cited

U.S. PATENT DOCUMENTS 2,545,258 3/1951 Cailloux .
3,779,399 * 12/1973 Shigeno et al. ..... 254/84
4,790,400 * 12/1988 Sheeter ..... 180/8.6
4,865,293 * 9/1989 Ishi et al. ..... 254/2 R
5,890,553 * 4/1999 Bar-Cohen et al. ..... 180/81
5,921,336 * 7/1999 Reed ..... 180/8.1

FOREIGN PATENT DOCUMENTS 27 03 482 8/1978 (DE) .
39 16 539 11/1990 (DE) .
40 17 960 12/1991 (DE) .
0 162 765 11/1985 (EP) .
2 179 572 11/1973 (FR) .

* cited by examiner

*Primary Examiner*—David A. Scherbel
*Assistant Examiner*—Daniel Shanley
(74) *Attorney, Agent, or Firm*—Young & Thompson

(57) ABSTRACT

A positioning actuator with three axes includes a base having a movable supporting member and a device for moving the member up and down, and a shaft connecting the movable head of the actuator to the base. The connecting shaft forms a swivel-type double linkage enabling sideways movement of the head relative to the base, and the lower end of the connecting shaft engages a part made of elastomeric material and is provided within the movable supporting member.

14 Claims, 7 Drawing Sheets

TRIAXIAL POSITIONING ACTUATOR AND CONTROL METHODS USING SAME

BACKGROUND AND SUMMARY OF THE INVENTION

The present invention relates to three-axis positioning jacks, capable of supporting objects whose weights can be as high as several hundred metric tons whilst allowing their positioning with an accuracy of the order of one micrometer.

At present, when a structure has to be positioned or shaped with respect to a foundation, jacks are used which are disposed between that foundation and the structure. These jacks are adjusted manually or electrically by agents who will carry out iterative adjustment operations until the desired position is reached. It is however extremely difficult in practice, if not impossible, to obtain high accuracy in such a context.

For the positioning of these structures, the actuators normally used are jacks, the two best known types of which are:

mechanical jacks, hydraulic jacks.

The mechanical solution, which is the most conventional one, uses a micrometric ball screw driven by a stepper motor. A compensation system often relieves the screw for heavy load applications. The principle of the hydraulic jack is itself so well known and its use is so widespread that a description of this type of jack would be superfluous if our new jack did not exhibit similarities with this technology.

In a hydraulic jack, a piston, provided with a fluid-tight seal, is free to move in the base of the jack, whose chamber is filled completely with a liquid which is only very slightly compressible. The piston moves, either because the volume of liquid in the chamber is modified by the injection or evacuation of the liquid via a pipe, a pump, a stop valve and a reservoir, or because an actuating piston, which is also provided with a fluid-tight seal, driven for example by a screw/nut assembly, modifies the shape of the chamber. As the liquid is virtually incompressible, the piston moves such that the volume of the chamber remains practically constant.

However, this type of jack which makes it possible to apply very high forces has three disadvantages:

- the equipment is often dirty, the fluid-tightness of the hydraulic chambers becoming relative because of the wear and ageing of the seals;
- micrometric positioning is impossible, the slight leakages and the high coefficient of expansion of the liquids used give rise to this positioning inability;
- the manufacturing cost is generally high, the friction surfaces necessitating precise and high-quality practices.

From the French patent FR 2179572 there is known a force multiplier device comprising a first hydraulic jack, whose piston rod is mounted slidingly in an enclosure integral with the base of that jack and constituting the chamber of a second jack also equipped with a sliding piston subjected to the action of an elastomer confined in that chamber and transmitting pressures in a hydrostatic manner.

There is also known, from the German patent DE 3916539, a transmission and/or pressure device comprising a principal piston driven by a rod subjected to a pressure. This piston acts on an elastomer mass confined in a chamber and which provides transmission of pressure to two actuating pistons. These actuating pistons are controlled in displacement by piezoelectric actuators.

These force multiplier devices use an elastomer mass as a working fluid. They cannot however provide the function of a positioning jack offering the accuracy required here. In fact, in the device described in the document FR 2179572, the first jack or actuating jack is a hydraulic jack, which makes it difficult to attempt to achieve high accuracy. Furthermore, the transmission device divulged in the document DE 3916539 is not a force multiplier and cannot be used as a positioning jack since its principal piston has a cross-section less than that of the actuating pistons controlled by the piezoelectric actuators and small travels are therefore obtained at the level of the actuating pistons and a large travel of the principal piston is obtained, which would not make it possible to obtain the required level of accuracy.

The purpose of the present invention is to overcome these disadvantages by proposing a three-axis positioning jack which procures a high positioning accuracy whilst being of less expensive and more reliable construction than those of jacks of the prior art.

This purpose is reached with a three-axis positioning jack with at least one motorised axis, comprising:

- a base comprising movable supporting means and means for vertically displaying said movable supporting means, and
- a rod providing a link between the movable head of said jack and said base.

According to the invention, the linking rod is designed to form a double connection of the ball joint type providing with a lateral displacement of the head with respect to the base, and the movable supporting means comprise an elastomer mass on which the lower end of the linking rod is supported.

Such a jack allows, by means of the double link of the ball joint type, a more accurate tridimensional positioning than what can be expected from present jack techniques. Implementing a piece made with an elastomer material procures effort transmission and damping functions that are particularly appreciated in position controls for heavy structures.

Moreover, in a first embodiment of jacks according to the invention, the piece made from an elastomer material can be advantageously used as a working fluid.

Thus, there is proposed a three-axis positioning jack having at least one motorised axis, comprising:

- a base comprising a bore containing a chamber in which there is confined a working fluid and a rod providing a link between the head of the jack and the base,
- and means for modifying the shape of the confinement chamber for the purpose of obtaining a vertical displacement of the head, these means comprising at least one motorised actuating piston, characterized in that the working fluid is constituted by the elastomer mass.

In this first embodiment, the solid elastomer mass, which behaves like a quasi-fluid when under load, is deformed by an actuating piston which is motorised. This deformation has the effect of displacing the working piston in order that the volume of the chamber remains constant. The servo-control of a one-axis motorised jack according to the invention with respect to an absolute reference allows easy use of the latter in installations requiring an alignment of deformable structures. Furthermore, one-axis jacks according to the invention can be designed such that they are extra-flat.

The condition for correct operation of this new type of jack is that the pressure generated by the load applied to the piston which compresses the elastomer must be sufficient for the latter to behave like a quasi-fluid without, however, its viscosity lowering to such an extent that the polymer can be extruded through the construction clearance between the piston and the bore made in the base of the jack. This jack has minimum and maximum loads proportional to the cross-section of the bore-piston pair and to the Shore hardness of the elastomer used.

In a second embodiment of the present invention, there is proposed a three-axis positioning jack, characterised in that the movable supporting means comprise a movable piece for receiving the elastomer piece acting as a ball joint, said movable piece being slidingly mounted with respect to the base and being actuated by micrometric ball screw means.

This jack further comprises preferably a second elastomer piece acting as a ball joint between the higher end of the connecting rod and the movable head.

A bone-shaped connecting rod with complex-shaped ends can be provided, with said elastomer pieces preferably having housings or hollows fitted for receiving the respective ends of the connecting rod. Cylinder-shaped elastomer pellets can also be used with plane supporting faces against which plane or substantially plane ends of a connecting rod are supported.

Jacks according to the invention are compact and of small size. Furthermore, they are easy to produce and are therefore economical. Their functioning is reliable since there is no longer any risk of a sealing breakdown. Furthermore, coupled with servo-control means, jacks according to the invention allow very accurate positioning because of a high positioning resolution.

In this way there are available, with three-axis positioning jacks according to the invention, particularly effective actuators for carrying out positioning of a heavy structure with respect to an absolute reference or of several structures with respect to each other, with a high level of accuracy, since by combining several three-axis jacks according to the invention (for example three three-axis jacks of which two axes are motorised), it is possible to control the six degrees of freedom of an object.

Within the framework of the present invention, it is possible to provide:

- a three-axis positioning jack, two of the axes being motorised, one of them being vertical and the other planimetric, the remaining axis being free or guided;
- a three-axis positioning jack having a vertical motorised axis, the other two planimetric axes being free or guided.

A three-axis positioning jack of which two axes are motorised can furthermore comprise a motorised stop to procure a lateral displacement of the head of the jack along a first horizontal axis. This motorised stop comprises for example an actuating screw driven by a motor reduction gear.

Furthermore, in order to achieve manual guidance or displacement of the head of the jack along the non-motorised horizontal axis, it is possible to provide a screw and its thrust ring for this purpose.

Three-axis positioning jacks according to the invention can advantageously be servo-controlled in position with respect to an absolute reference, along at least one of the said motorised axes.

According to particular embodiments of one or three-axis jacks according to the invention,

- additional actuating pistons can be distributed over the periphery of the chamber in order to increase or pre-adjust the travel of the jack; these actuating pistons are then driven by a screw-nut system which can be motorised or hand-driven;
- a mechanical system for pre-loading (by springs) the elastomer can be provided for use under very light loads;
- a displacement sensor can be associated with the jack for the servo-controlled versions.

Displacement sensors can be associated with all of these embodiments, allowing a relative servo-control of these jacks.

According to yet another aspect of the invention, there is proposed a method for the servo-control of the position of a structure supported by positioning jacks according to the invention, comprising measurements of the position of this structure and with each jack being servo-controlled on the basis of these measurements and of position commands.

Advantageously, it is possible to use a set of N jacks with one servo-controlled axis, to act on a deformable solid and to define its geometry, for example for the servo-levelling or servo-alignment of large machines or of long tubes, or for correcting the shape of a deformable solid of large size, or for achieving the flatness of a frame of a large machine tool or the straightness of the movement of translation of a large mass.

Servo-controls of N jacks according to the invention using the appropriate number of sensors measuring with respect to one or more absolute references are also included within the scope of the present invention.

Other features and advantages of the invention will furthermore appear in the following description. In the accompanying drawings given by way of non-limitative examples:

DESCRIPTION OF THE PREFERRED EMBODIMENTS

Several embodiments of jacks according to the invention, with three axes of displacement, with one or two motorised axes, will now be described with reference to FIGS. 1 to 6.

These jacks are particularly appropriate when an object has to be positioned and servo-controlled in space. In fact, in order to position and maintain an object in space, it is necessary to manage its six axes of freedom. These axes are generally controlled by three actuators which manage the different axes and support the weight of the object to be positioned. The solution traditionally employed uses three jacks oriented along the vertical axis Z which manage and control that vertical axis by simultaneous movements, and the rotations in the horizontal plane Ox, Oy by differential movement. A cross-movements table placed under one of the jacks manages the horizontal displacements of the X and Y axes. A third means of simple translation is disposed under one of the other two jacks and oriented along the Y axis is also necessary in order to manage the last axis Oz.

The use of three three-axis jacks therefore has the advantage of combining the two movements, vertical and planimetric respectively, whilst taking up very little volume. The six degrees of freedom of an object can be controlled by supporting it with three three-axis jacks. The positional servo-control of the object to be supported is then controlled by sensors which measure the displacements of the structure directly. The measurements are made either with respect to the ground (relative servo-control), or with respect to absolute references such as a taut line, a light beam, a liquid surface or any other equivalent means. This therefore makes it possible to position two or more blocks with respect to each other.

Figure 2:
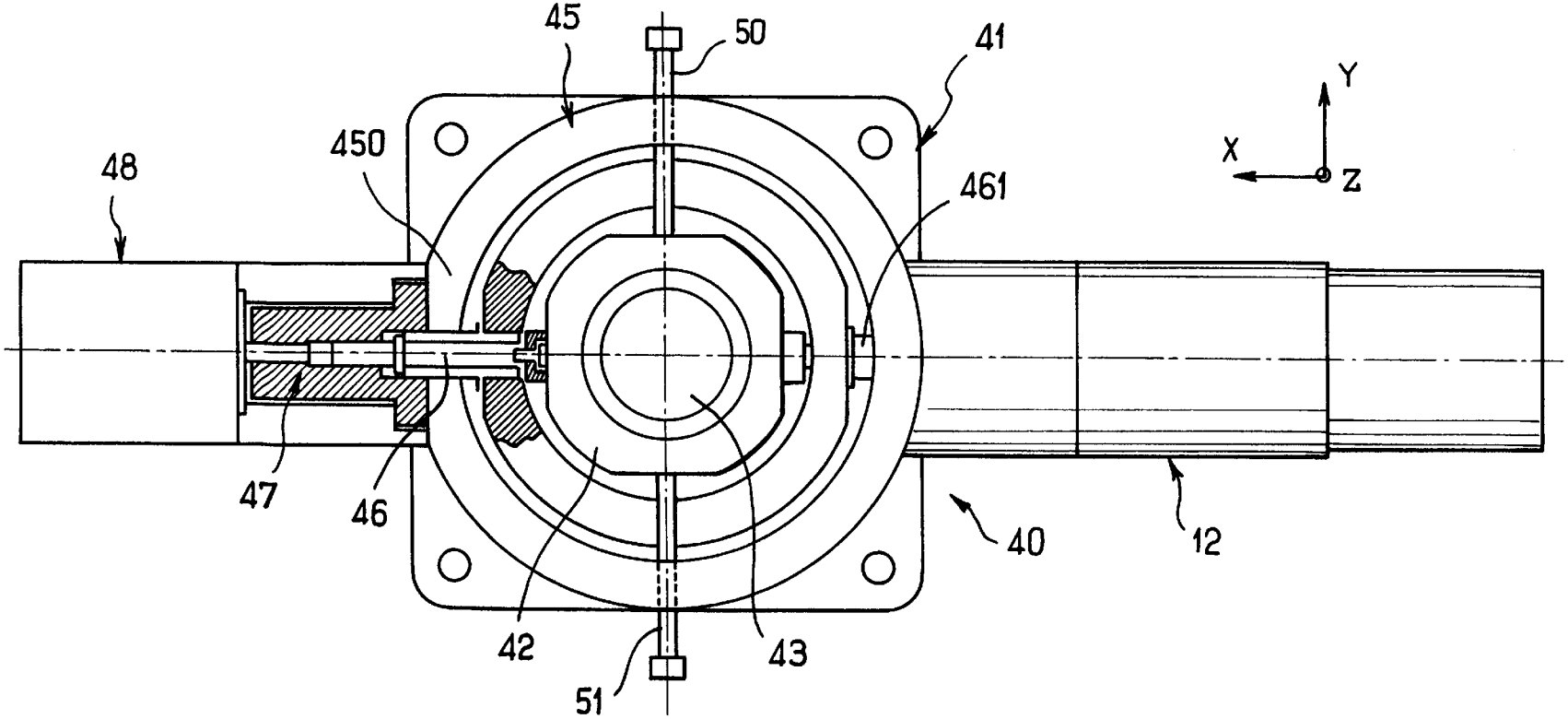
FIG. 2 is a cross-sectional plan view of the jack shown is FIG. 1.
Figure 3:
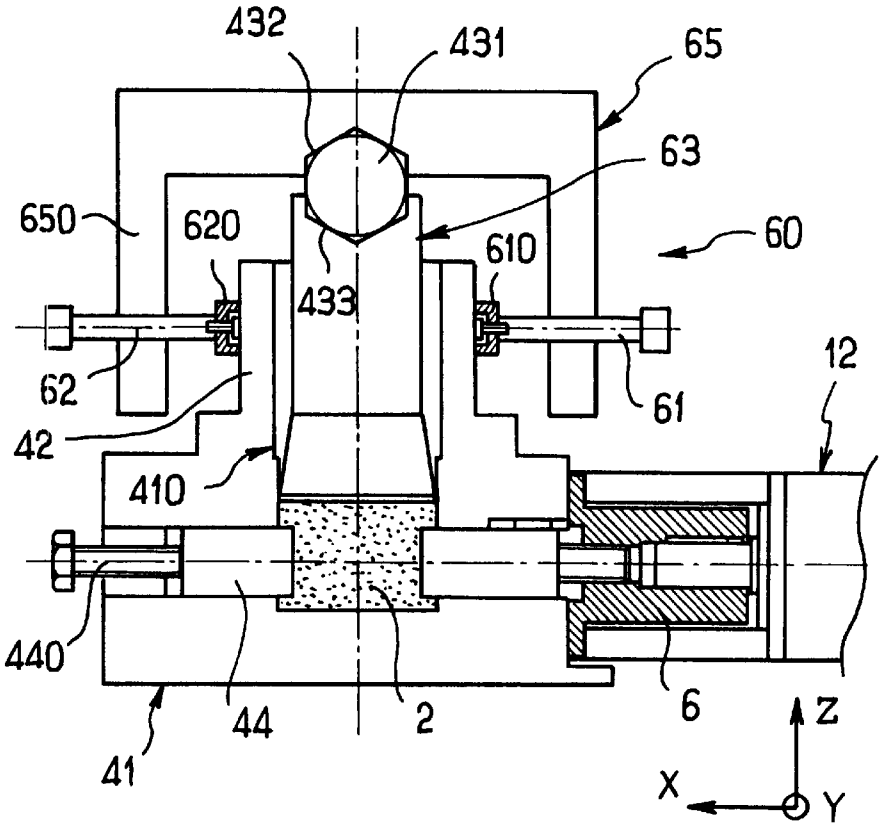
FIG. 3 is a cross-sectional view of an embodiment of a three-axis jack, according to the invention, of which one axis is motorised.
Figure 4:
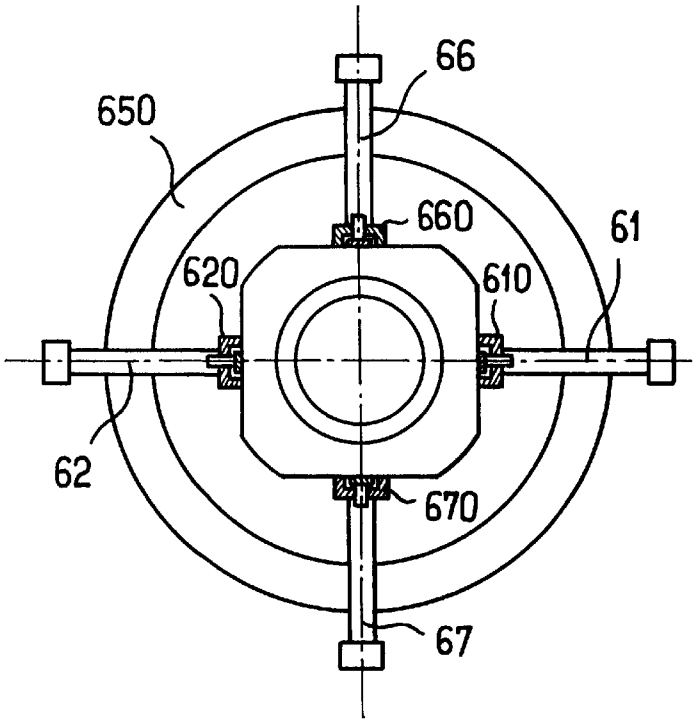
FIG. 4 is a cross-sectional plan view of the top part of the jack shown in FIG. 3.

According to particular variant embodiments of the invention, it is possible to devise:

- a jack 40 allowing motorised displacements along two axes, the vertical axis Z and the lateral axis X (FIGS. 1 and 2);
- a jack 60 allowing motorised displacement along the vertical axis and displacements by manually adjustable stops along its horizontal axes X and Y (FIGS. 3 and 4).

Figure 1:
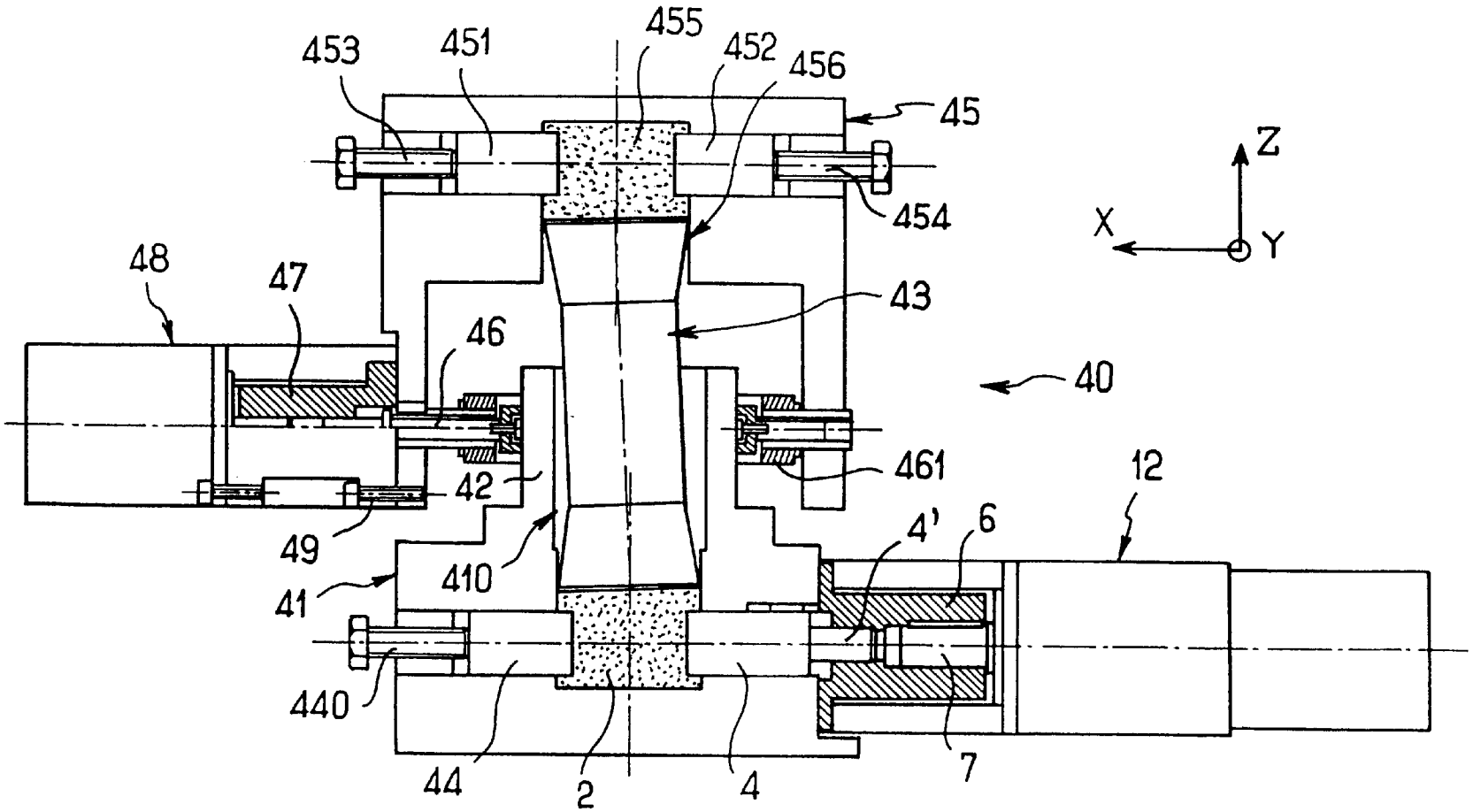
FIG. 1 shows a cross-section of an embodiment of a three axis jack, according to the invention, of which two axes are motorised.

With reference to FIG. 1, the base 41 of the jack 40 according to the invention comprises a bore 410 which receives a first elastomer pellet 2 and a bone-shaped piston 43 of the double ball joint type whose lower end bears against the pellet 2. The jack furthermore comprises a movable head 45 comprising a bore 456 containing a second elastomer pellet 455 against which the upper end of the piston 43 bears, and a peripheral cylindrical section 450.

The vertical movement Z is obtained by the action of actuating pistons 44, 4 on the elastomer 2, manually adjustable actuating pistons 44 providing the initial adjustment of the positioning, and at least one actuating piston 4 being motorised for the positional servo-control. Besides the vertical movement, the geometry of the piston allows the rotations about the X and Y axes which then generate movements of translation along the X axis and the Y axis respectively of the head of the jack 40. The elastomer pellet 455 is confined in the second chamber whose shape is modified by the displacement of two actuating pistons 451, 452 controlled manually by adjusting screws 453, 454.

This makes it possible to increase the vertical travel and to tolerate non-parallelism of the base of the jack with respect to its head.

The motorisation on the horizontal axis X is achieved by means of a motorised stop bearing against the external periphery 42 of the base 41 and driven by a motor reduction unit 48 for the driving along the axis in question and comprising:

- a thrust ring 461 which provides the guidance on the axis in question X and adjustment of the operational play, and
- a drive screw 46.

The motor reduction unit 48 is attached to the head 45 of the jack 40 by attachment means 49. The drive screw 46 is displaced in translation by a motorised yoke 47 driven by the shaft of the motor reduction unit 48. The second horizontal axis Y is simply blocked by the intermediary of unlockable stop screws 50, 51, as shown in FIG. 2.

Figure 6:
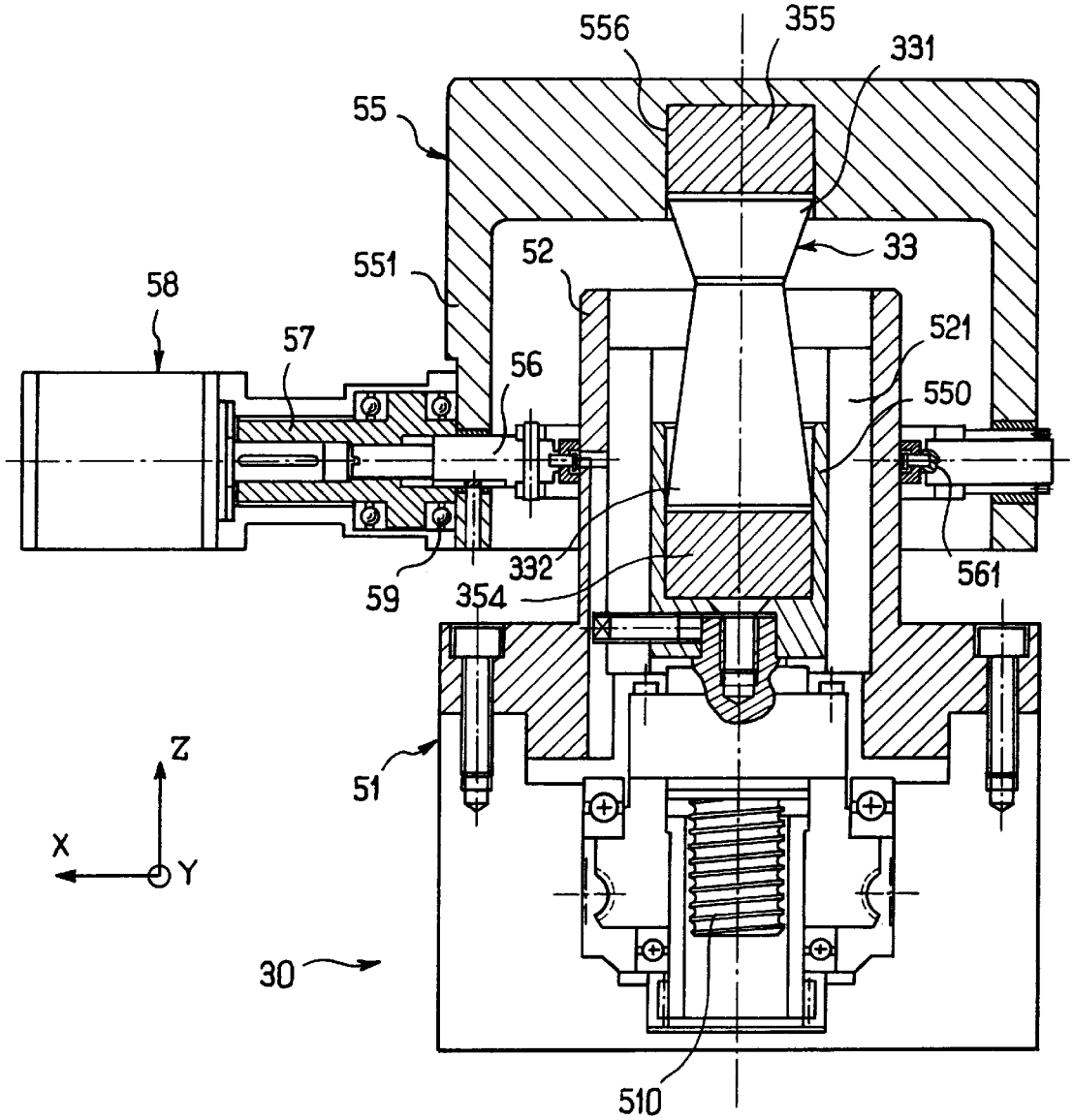
FIG. 6 is a cross-sectional view of a second example of said other embodiment of a three-axis jack according to the invention.
Figure 7:
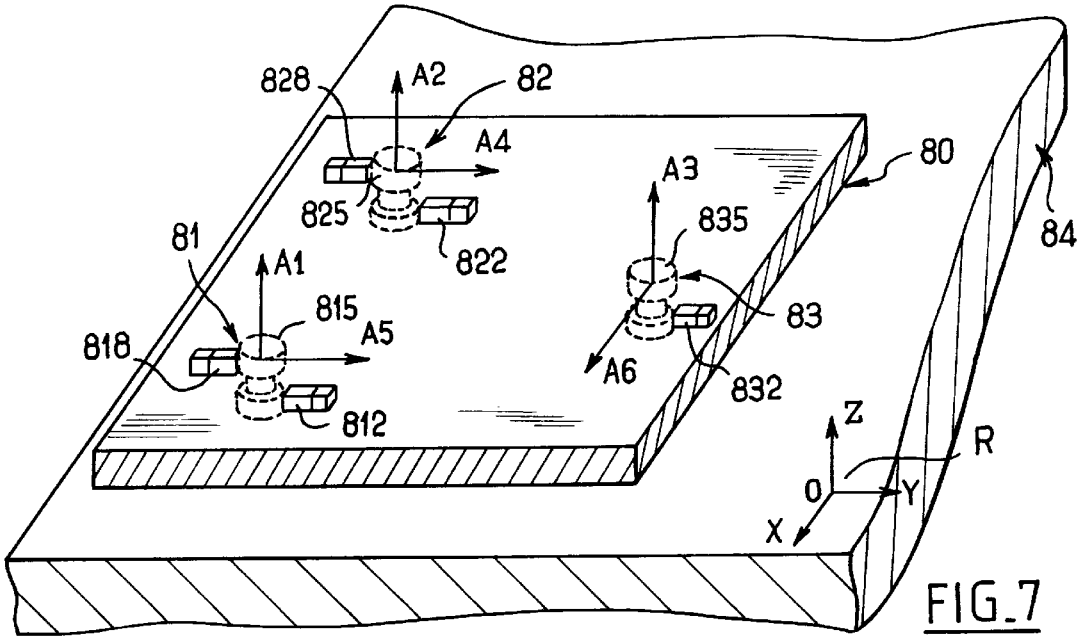
FIG. 7 shows an example of the use of three jacks according to the invention in order to control the six degrees of freedom of a structure.

In a variant of this embodiment, shown in FIGS. 3 and 6 wherein identical references have been used for identical elements already shown in FIGS. 1 and 2, the two horizontal axes X, Y are acted upon by non-motorised manual stops 610, 620; 660, 670 which can be adjusted by screws 61, 62; 66, 67 traversing the top part 65 of the jack 60. This jack 60 comprises a bore 410 receiving an elastomer pellet 2 and a piston 63 whose ball-joint shaped base rests on the elastomer pellet 2 and whose upper end comprises a housing 433 designed for receiving a ball 431 providing the second ball joint function, the top part 65 also comprising an appropriate housing 432 for receiving this ball.

Figure 5:
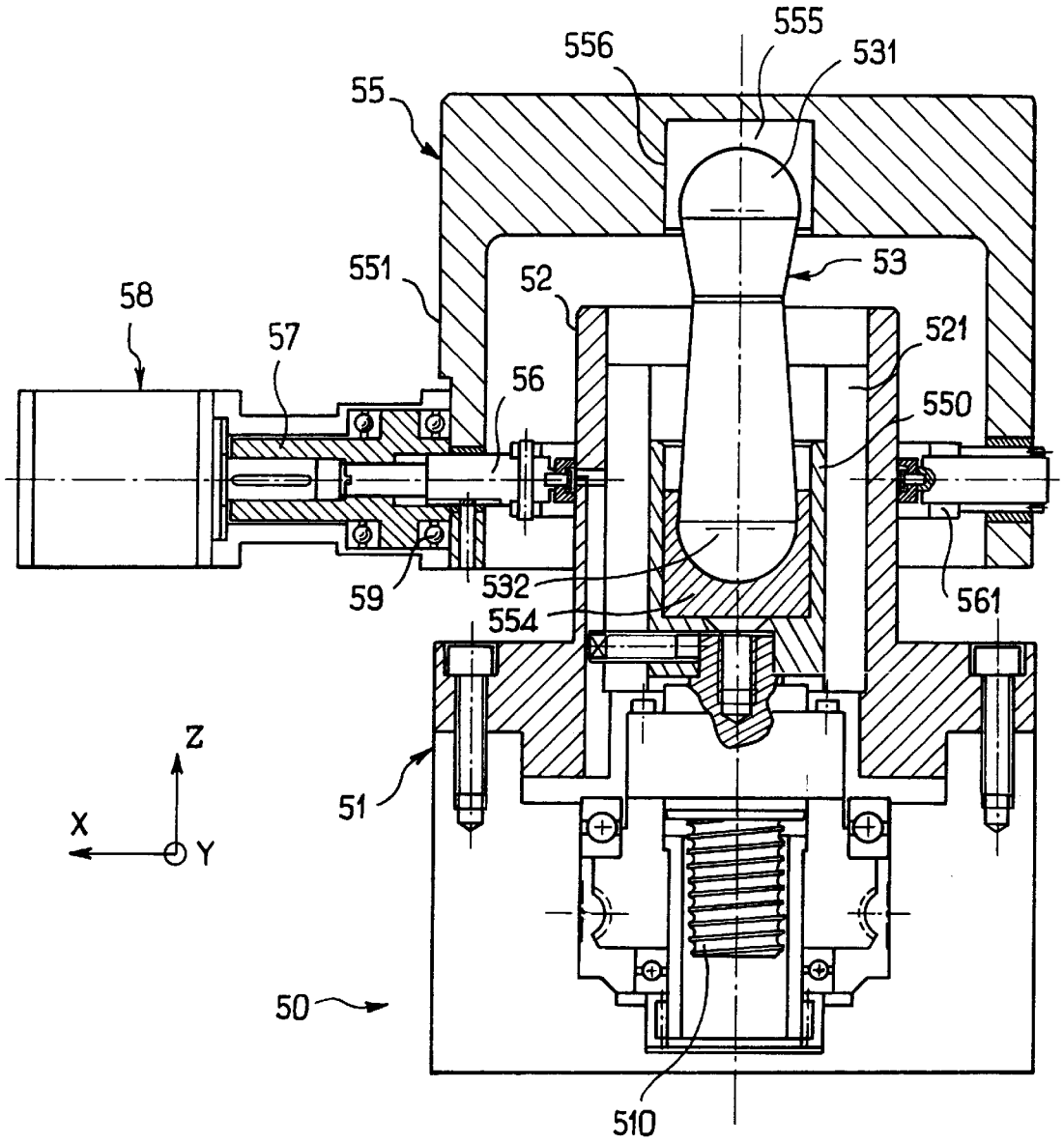
FIG. 5 is a cross-sectional view of a first example of another embodiment of a three-axis jack according to the invention.

In another embodiment of a three-axis according to the invention, the ball joints are made in elastomer material and the following displacement of the connecting rod is achieved by a micrometric ball-screw device, with reference to the examples of embodiment illustrated by FIGS. 5 and 6 wherein common elements feature common references.

Thus, the jack 50 comprises a base 51 provided with a higher cylindrical part 52 comprising a bore 521 wherein a movable piece 550 slides whose positioning is controlled by a micrometric screw-ball device 510. The movable piece 550 is designed for receiving a first piece 554 made in elastomer material wherein a lower end 532 of a bone-shaped piston 53 of the double ball-joint type. The higher end 531 of the piston 53 is housed in a second piece 555 in elastomer material fitted into a bore 556 of a movable head 55 of the jack 50.

The vertical movement along Z of the movable head 55 is obtained by acting on the micrometric ball-screw device 510 which can be actuated by a stepper motor. The two elastomer pieces 554, 555 achieve both a function of ball-joint link and a function of damping.

In addition to the vertical movement, the geometry of the piston 53 allows rotations around the axes X and Y which therefore generate translations respectively on the axis X and the axis Y of the head of the jack 50. Motorisation on the horizontal is achieved by means of a motorised stop supported on the external periphery of the higher part 52 of the base 51 and actuated by a motoreductor 58 for control on the considered axis, and comprising:

- a thrust stop 561 which ensures guiding on the considered axis X and adjusting of the working looseness; and
- an action screw 56.

The motoreductor 58 is mounted on the peripheric cylindrical part 551 of the head 55 of the jack 50 by mounting means 59. The action screw 56 is displaced in translation by means of a motorised nut 57 driven by the shaft of the motoreductor 58. The second horizontal axis Y is merely blocked by means of stop screws.

In a second example of this embodiment with a micrometric ball-screw illustrated by FIG. 5, the piston 33 of the jack 30 comprises respectively lower and higher substantially plane ends 332, 331 which bear against respectively a first and a second pieces 354, 355 in elastomer material. Said first and second pieces 354, 355, which for example are shaped as cylindrical pellets, are respectively housed inside the sliding movable piece 550 and into the bore 556 provided inside the movable head 55.

There will now be described an example of the use of the positioning servo-control method using jacks according to the invention and combinations of sensors used for measuring the position of a structure, with reference to FIGS. 7 to 11.

The servo-control method according to the invention can for example be used for maintaining the geometry of a deformable structure. The use of N jacks with one motorized axis servo-controlled with respect to external absolute references therefore makes it possible to compensate for ground movements, mechanical stresses, etc., for example for the alignment of a long tube or the levelling of a machine tool.

Figure 11:
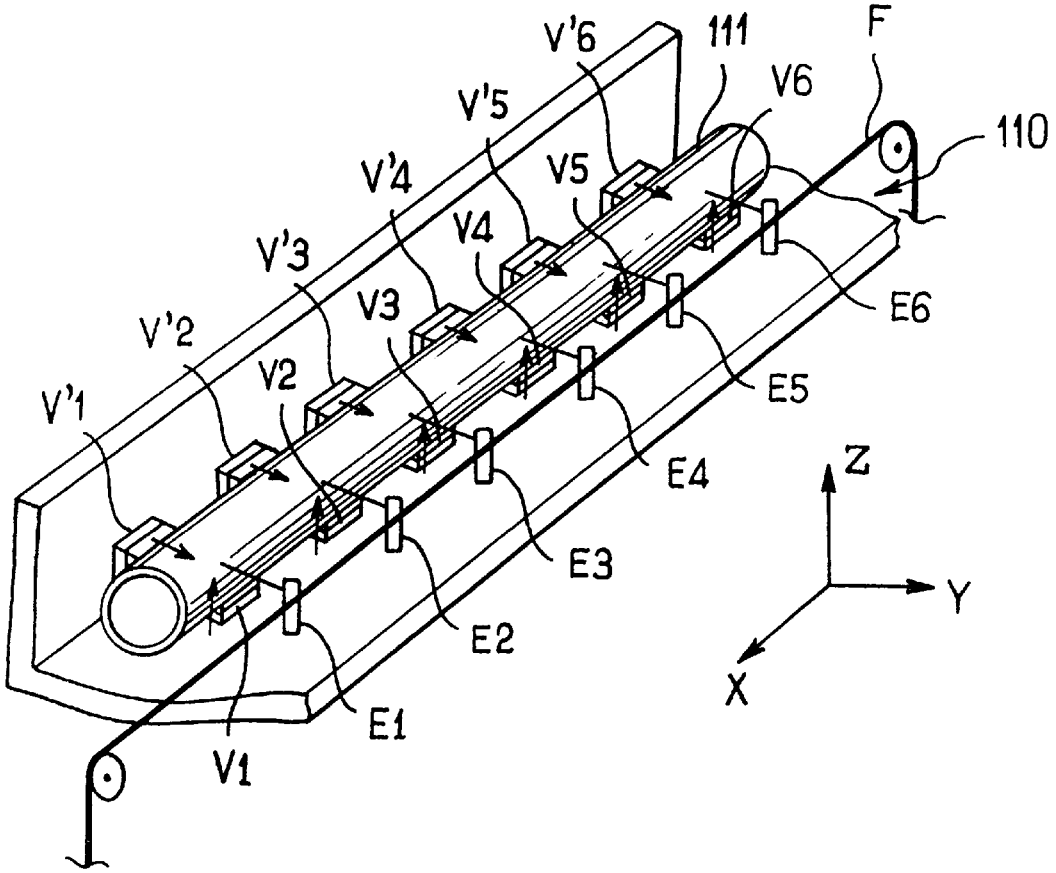
FIG. 11 shows an example of the use of a set of one-axis jacks according to the invention for the alignment of long tubes.

In a first configuration shown in FIG. 11 which represents a system for the alignment of a long tube, the absolute reference is defined by a taut wire F. A long tube 111 rests on a first set of one-axis jacks V1–V6 according to the invention disposed in the axis Z to be corrected, whilst a second set of one-axis jacks V'1–V'6 according to the invention is disposed along the tube 111 and in the horizontal axis X. A set of biaxial deviation measuring devices E1–E6 makes it possible to take biaxial deviation measurements with respect to this line in order to correct the alignment of the tube 111.

In a second configuration, the reference can be defined by a stretch of water defining horizontality.

In a third configuration, the reference can be defined by one-axis or two-axis inclinometers.

Three-axis jacks according to the invention can for example be used for the spatial position servo-control of two or of N non-deformable structures 80. There is carried out, using the servo-control method according to the invention, a control of the six degrees of freedom of non-deformable structures 80 each supported by three three-axis positioning jacks 81, 82, 83 according to the invention disposed on the ground 84, each of these positioning jacks 81, 82, 83 being allocated to one vertical displacement axis A1, A2, A3 and one lateral displacement axis A5, A4, A6. Each positioning jack 81, 82, 83 according to the invention is provided with a first motor reduction unit 812, 822, 832 for driving an actuating piston controlling the vertical displacement Z and the tilts Θx, Θy of the structure. Two positioning jacks 81, 82 are furthermore provided with a second motor reduction unit 818, 828 for driving a motorized stop controlling the displacement Y and Θz of the structure. The third positioning jack 83 is provided with a manually adjustable stop controlling the displacement along the horizontal axis X.

This servo-control method comprises a detection of the spatial position of each structure 80 with respect to an absolute reference R, and a closed loop servo-control of three positioning jacks 81, 82, 83 with respect to this reference.

Figure 8:
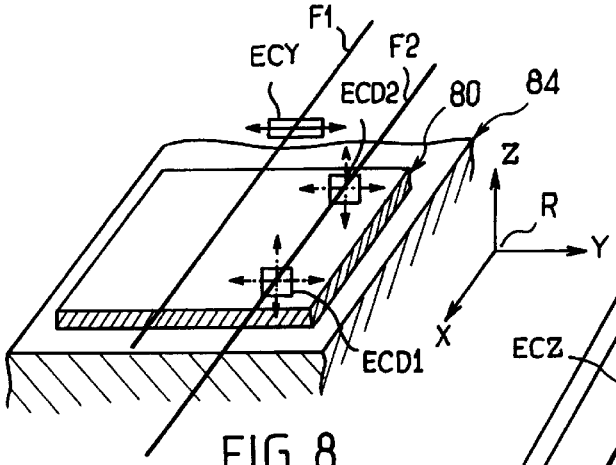
FIG. 8 shows a first combination of sensors used for providing a spatial position with respect to absolute references of a non-deformable structure.

In a first configuration, shown in FIG. 8, the absolute reference is defined by two taut wires and the position measurements comprise:

a uniaxial measurement of deviation ECZ from a wire made at a first point in the structure 80 along a vertical axis Z, with respect to a first taut wire F1 along a first horizontal axis X, and two bi-axial measurements of deviation ECD1, ECD2 each made along the vertical axis Z and along the second horizontal axis Y at two other different points, with respect to a second taut line F2 along a second horizontal axis X.

Figure 9:
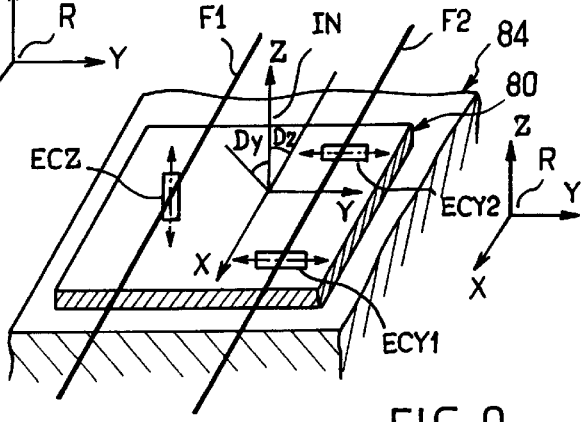
FIG. 9 shows a second combination of sensors used for providing a spatial position of a structure in the servo-control method.

In a second configuration, shown in FIG. 9, the absolute reference is defined by two taut wires and the position measurements comprise:

a uniaxial measurement of deviation ECZ along a vertical axis Z, with respect to a first taut wire F1 along a first horizontal axis X, two uniaxial measurements of deviation ECY1, ECY2 made at two different points along a second horizontal axis Y related to a second taut wire F2 along a second horizontal axis, and two clinometric measurements IN to provide two measurements Dx, Dy of the inclination of the structure 80 with respect to the vertical axis Z, about the first horizontal axis X and about the second horizontal axis Y respectively.

Figure 10:
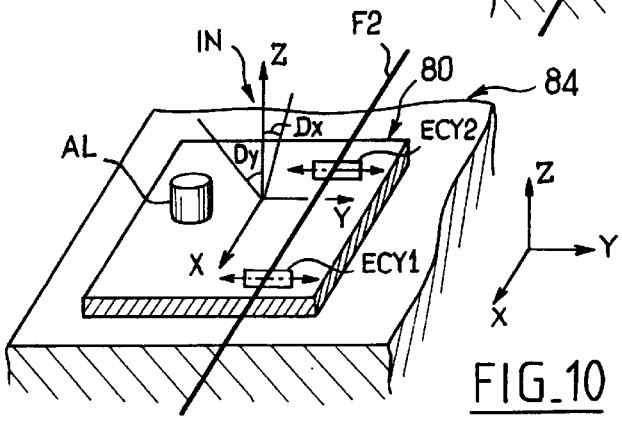
FIG. 10 shows a third combination of sensors used for providing a spatial position of a structure in the servo-control method according to the invention.

In a third configuration shown in FIG. 10, the position measurements comprise:

an altitude measurement AL made at a first point in the structure 80 along a vertical axis Z, two uniaxial measurements of deviation ECY1, ECY2 made at two different points along a second horizontal axis Y, with respect to a taut wire F2 along a first horizontal axis X, and two biaxial clinometric measurements IN to provide two measurements Dx, Dy of the inclination of the structure 80 with respect to the vertical axis Z about the first horizontal axis X and about the second horizontal axis Y respectively.

The position measurements are for example made at the locations of the jacks, but can very well be made at other points in the structure. With each positioning jack 81, 82, 83 there is associated a measurement along the vertical axis Z, and with two of the said positioning jacks 81, 82 there are associated the two measurements along the second horizontal axis Y.

The invention is not of course limited to the examples which have just been described and many developments can be applied to these examples without departing from the scope of the invention. It is possible, for example, to design other embodiments of the positioning jacks. Other combinations of position sensors can also be envisaged. It is possible to use polyurethane or natural rubber for producing the elastomer mass. This mass can consist of a multitude of elastomer balls.

What is claimed is:

1. Three-axis positioning jack having at least one motorised axis, comprising:

a base comprising a movable elastomer mass and means for vertically displacing said movable elastomer mass; and a connecting rod linking a movable head of said jack and said base, wherein said connecting rod forms a double ball joint connection allowing lateral displacement of said head with respect to said base, and wherein said movable elastomer mass bears a lower end of said connecting rod.

2. Three-axis positioning jack of which two axes are motorised according to claim 1, further comprising at least one motorised stop to procure a lateral displacement of the head of the jack along a first horizontal axis.

3. Three-axis positioning jack according to claim 1, further comprising means for producing a guidance or manual displacement along at least one of the two horizontal axes.

4. Three-axis positioning jack of which at least one axis is motorised, according to claim 1, wherein said base comprises a bore containing a chamber in which there is confined a working fluid that is said elastomer mass, and further comprising means for modifying the shape of the confinement chamber for the purpose of obtaining a vertical displacement of the head, these means comprising at least one motorised actuating piston.

5. Three-axis positioning jack according to claim 4, further comprising at least one additional actuating piston disposed on the periphery of the chamber in order to increase the travel of said jack.

6. Three-axis positioning jack according to claim 1, further comprising a movable piece for receiving the elastomer mass acting as a ball-joint, said movable piece being slidingly mounted with respect to the base and actuated by a micrometric ball-screw.

7. Three-axis positioning jack according to claim 6, further comprising a second piece acting as a ball-joint between the higher end of the connecting rod and the movable head.

8. Three-axis positioning jack according to claim 6, wherein at least one of said movable piece and said second piece comprises a recess arranged for bearing a substantially convex-shaped end of the connected rod.

9. Three-axis positioning jack according to claim 6, where at least one of said movable piece and said second piece is in the form of a pellet having a substantially plane face for bearing an end of the connecting rod.

10. Three-axis positioning jack according to claim 1, further comprising means for servo-controlling the jack in position along its axis or its axes using a closed loop system based on signals delivered by one or more position sensors.

11. Three-axis positioning jack according to claim 10, wherein the position sensor or sensors are placed on the head of said jack.

12. Three-axis positioning jack according to claim 10, wherein the position sensor or sensors are placed on an object carried by the jack.

13. Three-axis positioning jack according to claim 10, wherein the position sensor or sensors refer to one or more references related to the base of said jack.

14. Three-axis positioning jack according to claim 10, wherein the position sensor or sensors refer to one or more references independent of the base of said jack.

* * * * *